United States Patent [19]

Bevington et al.

[11] Patent Number: 4,802,819

[45] Date of Patent: Feb. 7, 1989

[54] CENTRIFUGAL PUMP

[75] Inventors: Jack T. Bevington; Alan B. Channell, both of Ashland, Ohio

[73] Assignee: McNeil (Ohio) Corporation, St. Paul, Minn.

[21] Appl. No.: 95,665

[22] Filed: Sep. 14, 1987

[51] Int. Cl.[4] ..... F04D 17/12

[52] U.S. Cl. ..... 415/199.3

[58] Field of Search ..... 415/199.1, 199.2, 199.3, 415/210

[56] References Cited

U.S. PATENT DOCUMENTS

| | | | |
|---|---|---|---|
| 1,387,660 | 8/1921 | Ostenberg | 415/199.3 |
| 2,954,739 | 10/1960 | Lung | 415/199.3 X |
| 3,025,800 | 3/1962 | Wolfe et al. | 415/199.3 X |
| 3,116,696 | 1/1964 | Deters | 415/199.3 X |
| 3,265,001 | 8/1966 | Deters | 415/199.3 X |
| 3,288,074 | 11/1966 | Hall | 415/199.3 |
| 3,477,384 | 11/1969 | Hlinka | 415/199.3 |
| 3,612,716 | 10/1971 | Deters | 415/199.3 X |

*Primary Examiner*—Robert E. Garrett
*Assistant Examiner*—Joseph M. Pitko
*Attorney, Agent, or Firm*—Renner, Kenner, Greive, Bobak, Taylor & Weber

[57] ABSTRACT

A multistage centrifugal pump, incorporates a first housing (14) having a cylindrical wall (30) defining a portion of the outer surface of the pump. A first diffuser (15) is fixed to the first housing (14) and has a discharge opening (43). A first impeller (16) is rotatably received within the first housing (14) in operative association with the first diffuser (15). The first impeller (16) includes an inlet opening (25). At least a second housing (14) is provided concentric with, and axially adjacent to, the first housing (14) and has a cylindrical wall (30) defining a portion of the outer surface of the pump. A second diffuser (15) is fixed to the second housing (14) and has a discharge opening (43). A second impeller (16) is rotatably received within the second housing (14) in operative association with the second diffuser (15). The second impeller (16) has an inlet opening (25) fluidly communicating with the discharge opening (43) of the first diffuser (15). A pilot region (32) is provided to axially align the first housing (14) with the second housing (14). A driven pump shaft (21) is operatively connected to each impeller (16). An inlet chamber (52) fluidly communicates with the inlet opening (25) of an impeller (16); and a discharge chamber (60) fluidly communicates with the discharge opening (43) of a diffuser (15).

7 Claims, 1 Drawing Sheet

CENTRIFUGAL PUMP

TECHNICAL FIELD

The present invention relates generally to submersible centrifugal pumps. More particularly, the present invention relates to centrifugal pumps having multiple axial stages. More specifically, the present invention relates to a multistage centrifugal pump having a plurality of individual stage sections.

BACKGROUND ART

Multistage submersible pumps often are used in water wells to supply water for residential, commercial and agricultural uses. The wells encountered may be quite deep rendering it necessary to employ a pump capable of developing great pressure in order to force liquid to the surface. Among the factors which control the amount of liquid output is the relatively small diameter of the well casing through which must pass the entire pump including external housing, motor, and the many stages which contact and move the liquid. To compensate for the limited diameter, numerous stages are stacked within the housing, resulting in a pump of considerable length, to achieve a lift of several hundred feet.

A typical prior art, multistage pump is disclosed in U.S. Pat. No. 3,779,668 entitled "Stage For A Centrifugal Pump". Such prior art pumps employ a continuous exterior pump housing, or casing, into which are stacked the various internal components which constitute the pump stages. The casing is closed at its lower and upper ends by a suction bowl and discharge bowl, respectively. A central pump shaft, coupled at one end to a motor, extends axially through the pump casing and operatively engages each impeller.

As can be appreciated, several inherent drawbacks exist in these prior art pumps. Specifically, the pump casing proves to be a costly feature of the pump both in manufacturing—it must be manufactured to exacting tolerances of concentricity throughout its length—and in operational efficiency—its diametrical size further restricts the size of the impeller and the area available to pump the fluid. Additionally, because the internal components merely are stacked within the pump casing, interstage leaking commonly occurs, that is, fluid from one stage leaks back to a preceding stage reducing the overall efficiency of the pump.

It also should be appreciated that a particular casing is suitable only for a specific number of stages. Whenever a pump of more or less stages is desired, it is necessary to manufacture a specific casing to house the particular number of stages. Furthermore, as the number of stages increase, the cost of manufacturing a casing to accommodate the stages increases disproportionately.

DISCLOSURE OF THE INVENTION

It is, therefore, a primary object of the invention to provide a submersible multistage centrifugal pump providing maximum internal area, for a given outside diameter, to move fluid.

It is another object of the present invention to provide a submersible multistage centrifugal pump, as above, which permits pumps of various number of stages to be assembled using many of the same components.

It is a further object of the present invention to provide a submersible multistage pump, as above, having improved operational efficiency by reducing interstage leakage.

It is yet another object of the present invention to provide a submersible multistage pump, as above, which is less costly to manufacture.

These and other objects of the present invention, as well as the advantages thereof over existing and prior art forms, which will be apparent in view of the following specification, are accomplished by means hereinafter described and claimed.

In general, a multistage centrifugal pump, according to the concept of the present invention includes a first housing having a cylindrical wall defining a portion of the outer surface of the pump. A first diffuser having a discharge opening is fixed to the first housing. A first impeller having an inlet opening is rotatably received within the first housing in operative association with the first diffuser. At least a second housing is provided concentric with, and axially adjacent to, the first housing and also has a cylindrical wall defining a portion of the outer surface of the pump. A second diffuser having a discharge opening is fixed to the second housing. A second impeller is rotatably received within the second housing in operative association with the second diffuser. The second impeller has an inlet opening fluidly communicating with the discharge opening of the first diffuser means. Means are provided to axially align the first housing with the second housing while a driven pump shaft is operatively connected to each impeller. An inlet chamber fluidly communicates with the inlet opening of an impeller; and, likewise, a discharge chamber fluidly communicates with a discharge opening of a diffuser.

EXEMPLARY EMBODIMENT FOR CARRYING OUT THE INVENTION

Figure 1:
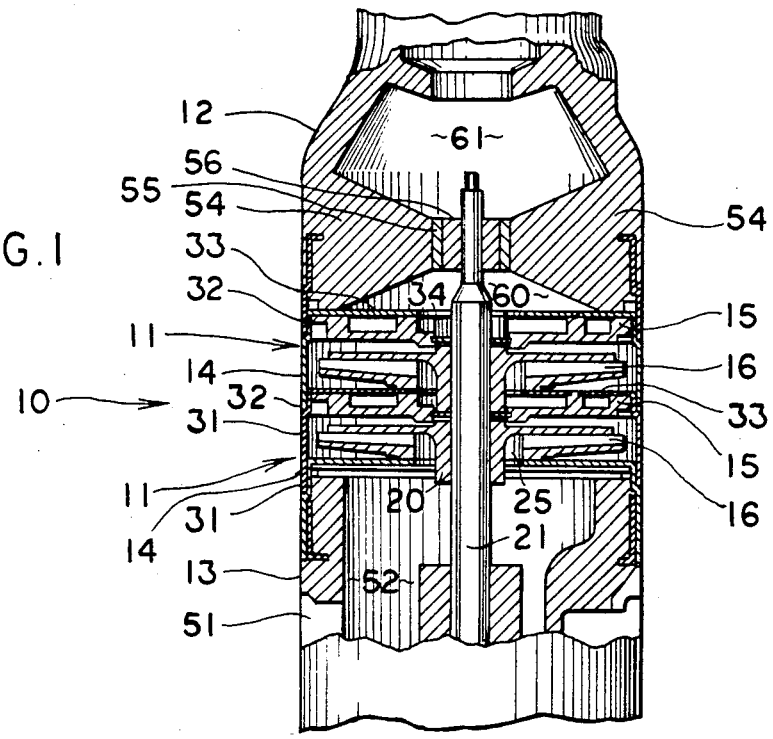
FIG. 1 is an elevational, fragmentary cross-section, of a multistage centrifugal pump embodying the concept of the present invention.

A centrifugal pump embodying the concept of the present invention is designated generally by the numeral 10 in FIG. 1 and has a plurality of stages, generally indicated by the numeral 11, as well as other conventional pump components. The upper end of the pump 10 includes a discharge bowl 12 which communicates with a threaded coupling for connection with the usual outlet pipe (not shown). At the lower end, the pump 10 includes a suction bowl 13 which can be suitably attached to a pump motor, and the like, again which is not shown herein. Each stage 11 includes a housing 14, a diffuser 15 mounted within housing 14 in a nonrotatable manner, and an impeller 16 which is clearanced to rotate within housing 14.

Figure 2:
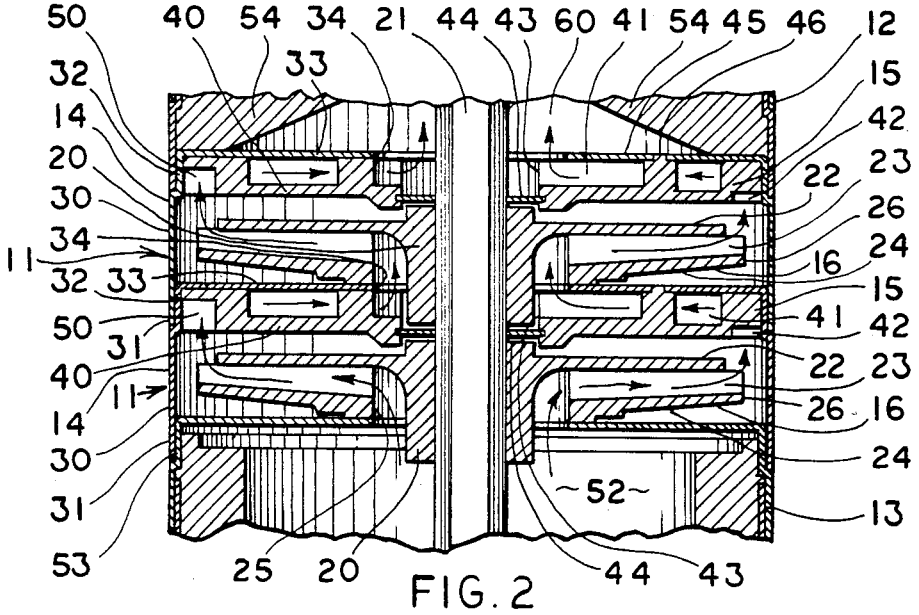
FIG. 2 is an enlarged fragmentary cross-section of the stages of the pump depicted in FIG. 1.

Impeller 16 has a central hub portion 20 which is of a configuration such that it can readily be affixed to and therefore rotatably driven by pump shaft 21. A rear or vane plate 22 extends radially outwardly from hub 20 and can carry a plurality of spirally extending pump vanes 23 as would be appreciated to one skilled in the art. Impeller 16 also has a front shroud 24 which terminates radially inwardly so as to define an aperture 25 concentric with hub 20 and forming therewith an annular inlet for the liquid. As seen in FIGS. 1 and 2, shroud 24 extends radially beyond the outer diameter of vane plate 22 and thereafter terminates in an axial rim 26 having a diameter slightly less than that of housing 14 so as to be freely rotatable therein.

Impeller vanes 23 are each conveniently mounted between impeller vane plate 22 and shroud 24. When manufactured, vane plate 22 integrally carries vanes 23. As shown in FIG. 2, the vanes 23 extend axially from vane plate 22 to shroud 24 wherein they may be cemented or fastened by other suitable means to shroud 24. In such a manner, vane plate 22 and shroud 24 are attached to form impeller 16 as an integral unit including vane plate 22 and shroud 24 with vanes 23 therebetween.

Housing 14 preferably includes a cylindrical outer wall 30 having an outside diameter equal to, and defining, the overall diameter of the pump 10. Outer wall 30 includes a rim 31 at its lowermost end and a pilot region 32, having a slightly smaller diameter, at its uppermost end. So configured, one housing 14 may be received partially onto and piloted with another housing 14 wherein pilot region 32 of one housing 14 is received within rim 31 of the next adjacent housing 14. In such fashion, housings 14 are aligned axially relative to each other. Housing 14 further includes an annular end wall 33 extending inwardly from pilot region 32 and having a centrally located aperture 34 therein for the egress of fluid pumped from the stage 11 contained within the respective preceding housing 14.

Inasmuch as housing 14 represents a portion of the structural body of pump 10 it preferably is made of a strong, corrosive resistant material, such as stainless steel or the like. Successive housings 14 are joined together, each containing a pump stage 11, to form the overall body of the pump 10. Housings 14 are so joined by positioning rim 31 of one housing 14 over pilot region 32 of another as discussed above and securing the two housings 14 together as by welding, or the like, after the internal components of the stage 11 are positioned within the respective housings 14. Not only does welding achieve structural integrity of the overall pump 10, but it also assures a fluid-tight joint between successive stages.

Diffuser 15 is mounted within housing 14 and includes a front plate 40, a series of guide vanes 41 and a like number of helical fins 42. Front plate 40 can be cast from a suitable plastic material and includes a central bore 43 which is provided with an annular insert 44 to form an axial support member for impeller hub 20 and to help impede the backflow of fluid to a preceding stage. Guide vanes 41 which may be similar to spiral impeller vanes 23, can be formed integral with front plate 40 and are provided with lugs 45 which are received in holes 46 in end wall 33 of housing 14, and cemented or otherwise fixedly secured therein to form diffuser 15 integrally with housing 14.

Front plate 40 extends radially outwardly from bore 43 to a diameter corresponding to the inside diameter of pilot region 32 of housing 14. Helical fins 42 are fixed to the periphery of front plate 40, may be cemented to housing 14, and extend axially toward end wall 33 of housing 14. Helical fins 42, and guide vanes 41 cooperate with housing 14 to form spirally inclined entrance passages 50 for fluid being expelled from impeller 16, to transfer the fluid toward central bore 43 and end wall 33. Thus, as shown by the arrow in FIG. 2, the fluid enters diffuser 15 and passes on helical fin 42 between corresponding guide vanes 41 and outer wall 30 of housing 14. As the fluid continues, it contacts guide vanes 41 and end wall 33 as it moves toward aperture 34 of housing 14.

The advantages of the present invention may be more fully recognized and appreciated by considering the operation of a pump constructed according to the concept of the present invention. With reference to FIG. 1, the operation of the pump 10 can be discussed for a two-stage pump. It must be appreciated that the pump 10 may have more or less stages 11 as required, while operating in the same manner herein described.

In operation, the liquid initially flows into the pump 10 through an inlet 51 and fills a chamber 52 defined by the configuration of suction bowl 13. Suction bowl 13 gives stability to the pump 10 and maintains the vertical position of the components thereof in that it engages the bottom of the first stage housing 14 and in that it carries an annular shoulder 53 which engages rim 31 of the first stage of housing 14. The mating between shoulder 53 and rim 31 is secured, and sealed as by welding or the like, so as to effect an integral assembly.

The liquid then flows axially from suction bowl 13 through impeller apereture 25 and is turned generally radially as it passes between vane plate 22 and front shroud 24 of the first stage 11. As the first impeller 16 rotates, vanes 23 drive the liquid generally radially until it reaches the axial rim of shroud 24 where the liquid is guided and turned a second time as it exits impeller 16 and contacts outer wall 30. Because the liquid exits impeller 16 substantially adjacent outer wall 30 of housing 14, there is no wasted space radially beyond the diameter of shroud 24 wherein the liquid would be diverted from axial movement. Of course, the increased diameter of impeller 16 has several beneficial results such as: more velocity per equivalent amount of power, a greater output with the same number of stages as a conventional pump, or alternatively employment of less stages and/or amount of power to yield the desired output of a conventional pump.

Beyond impeller 16, the axially moving liquid enters the spirally inclined passages 50 in front plate 40 of diffuser 15. As it moves radially inwardly and upwardly, in the manner previously described, the fluid approaches aperture 34 in end wall 33 of the first stage housing 14, with the velocity of the liquid having been reduced by the stationary guide vanes 41 within diffuser 15 while pressure is proportionately increasing.

As the fluid exits from aperture 34, it can be expelled from the pump, if the pump were one having a single stage, or if a multiple stage pump were involved as depicted in FIG. 1, the fluid could go directly to aperture 25 of impeller 16 of the next adjacent stage 11.

When the fluid exits from the last stage 11, it passes through discharge bowl 12 shown in FIG. 1. Discharge bowl 12 is nonrotatably carried on pilot region 32 of the last stage housing 14 and secured and sealed thereto as by welding or the like. Discharge bowl 12 includes a plurality of web members 54 which extend inwardly to an annular collar 55 which carries a shaft bearing 56 to rotatably support the upper end of pump shaft 21. Thus, as liquid passes through aperture 34 of the last housing 14, it flows into a chamber 60, through webs 54 and into a constricting chamber 61 leading either to the impeller of yet a subsequent stage or more preferably to the discharge outlet of the pump.

Thus, from the foregoing description it should be apparent to one skilled in the art that a centrifugal pump embodying the invention disclosed herein eliminates the need for an outer pump casing and thus provides a smaller diameter pump having greater, more efficient output. Moreover, the assembly of multistage pumps is made simpler and easier by permitting the desired number of stages to be welded or otherwise joined together without the need for costly and space-consuming external casings. As such, the present invention carries out the various objects disclosed herein and otherwise constitutes an advantageous contribution to the art.

We claim:

1. A multistage centrifugal pump, comprising:

a first pump stage including first housing means having a cylindrical wall defining a portion of the outer surface of the pump, fixed diffuser means fully received within and affixed to said first housing means and having a discharge opening, and first impeller means rotatably received within said first housing means in operative association with said fixed diffuser means of said first pump stage, said first impeller means having an inlet opening;

at least a second pump stage including second housing means concentric with, and axially adjacent to, said first housing means and having a cylindrical wall defining an axially adjacent portion of the outer surface of the pump, fixed diffuser means fully received within and affixed to said second housing means and having a discharge opening, and second impeller means rotatably received within said second housing means in operative association with said fixed diffuser means of said second pump stage, said second impeller means having an inlet opening fluidly communicating with said discharge opening of said fixed diffuser means of said first pump stage;

each said housing means including an annular end wall having a centrally located aperture, each said diffuser means being fixed to a corresponding said end wall within said respective housing means with said discharge opening adjacent said aperture;

means to axially align said first housing means with said second housing means including a rim located circumferentially about one said housing means and receivable onto a pilot region located circumferentially about a next adjacent said housing means;

a driven pump shaft operatively connected to each said impeller means;

an inlet chamber fluidly communicating with said inlet opening of a said impeller means; and a discharger chamber fluidly communicating with said discharge opening of a said diffuser means.

2. A multistage centrifugal pump, according to claim 1, wherein said pilot region of a said housing means is carried peripherally about a said corresponding end wall.

3. A multistage centrifugal pump, according to claim 2, wherein a said impeller means further includes a centrally located hub engageable with said driven pump shaft.

4. A multistage centrifugal pump, according to claim 3, wherein said hub of a said impeller means is receivable through said aperture of said end wall of a next adjacent housing means.

5. A multistage centrifugal pump, according to claim 4, wherein said hub of a said impeller means is receivable partially in said discharge opening of said diffuser means of a next adjacent housing means.

6. A stage for a centrifugal pump having a plurality of axially aligned stages comprising:

housing means having a cylindrical wall defining a portion of the outer surface of the pump and a annular end wall having a centrally located aperture;

diffuser means fully received within said housing means and affixed to said end wall of said housing means and having a discharge opening adjacent said aperture;

impeller means rotatably received within said housing means in operative association with said diffuser means, said impeller means having an inlet opening; and means to axially align said housing means with a housing means of an axially adjacent stage including a rim circumferentially about one axial end of said housing means and a pilot region circumferentially about the axially distal end of said housing means.

7. A stage according to claim 6 wherein said impeller means include a hub engageable with a driven pump shaft.

* * * * *